US006892038B2

(12) United States Patent
Fukutani

(10) Patent No.: US 6,892,038 B2
(45) Date of Patent: May 10, 2005

(54) IMAGE FORMING APPARATUS WITH RECORDING MEDIUM SPEED CONTROL FEATURE

(75) Inventor: Takayuki Fukutani, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/368,623

(22) Filed: Feb. 20, 2003

(65) Prior Publication Data

US 2003/0156853 A1 Aug. 21, 2003

(30) Foreign Application Priority Data

Feb. 21, 2002 (JP) ..... 2002-044807

(51) Int. Cl.[7] ..... G03G 15/20
(52) U.S. Cl. ..... 399/68; 399/397; 399/400
(58) Field of Search ..... 399/38, 67, 68, 399/397, 400; 271/10.05, 10.12, 10.13; 101/216, 232

(56) References Cited

U.S. PATENT DOCUMENTS

| | | | | |
|---|---|---|---|---|
| 4,928,141 A | | 5/1990 | Poehlein et al. | 355/208 |
| 4,941,021 A | | 7/1990 | Uchida et al. | 355/285 |
| 5,771,434 A | | 6/1998 | Hokari | 399/400 |
| 6,298,778 B1 | * | 10/2001 | Onodera et al. | 101/232 |
| 6,674,979 B1 | * | 1/2004 | Nagano | 399/68 |

FOREIGN PATENT DOCUMENTS

| | | |
|---|---|---|
| EP | 0 881 547 A2 | 12/1998 |
| JP | 2000-89534 | 3/2000 |
| JP | 2000-335027 | 12/2000 |
| JP | 2001-100587 | 4/2001 |

* cited by examiner

*Primary Examiner*—Hoan Tran
(74) *Attorney, Agent, or Firm*—Fitzpatrick, Cella, Harper & Scinto

(57) ABSTRACT

An image forming apparatus is provided, in which there occurs no pulling of a recording medium at different portions, and also, vibration of a trailing end of the recording medium during the time when the trailing end of the recording medium is passed through the transferring portion is suppressed. Thus, no deterioration occurs in image quality such as disturbance of a toner image. The image forming apparatus includes a transferring portion that transfers a toner image formed on an image bearing member onto a recording medium at a transfer position, a fixing portion that fixes the toner image transferred onto the recording medium, and a control portion that controls a fixing/conveying speed at which the fixing portion conveys the recording medium, to thereby control an amount of loop formed in the recording medium by the transferring portion and the fixing portion, in which, in response to a fact that a trailing end of the recording medium has reached a predetermined position on an upstream side of the transfer position in a conveying direction, the fixing/conveying speed is controlled to reduce the amount of loop.

21 Claims, 14 Drawing Sheets

IMAGE FORMING APPARATUS WITH RECORDING MEDIUM SPEED CONTROL FEATURE

BACKGROUND OF THE INVENTION

1. Field of the Invention

The present invention relates to an image forming apparatus and method that forms an image on a recording medium.

2. Related Background Art

Up to now, there have been known image forming apparatuses in which, when plural conveyor portions such as rollers are used to convey a recording medium, the plural conveyor portions are controlled so as to form a certain amount of flexure (loop) in the recording medium due to the plural conveyor portions.

As an example of the image forming apparatuses, there has been known an image forming apparatus of an electrophotographic system which includes a transferring portion that transfers a toner image on a photosensitive drum onto the recording medium, and a fixing portion that fixes the toner image on the recording medium, which has been sent from the transferring portion, by, for example, a heat roller method.

To explain with reference to the above-mentioned image forming apparatus of the electrophotographic system, the following problem can be observed. That is, if a fixing roller or the like constituting the fixing portion varies in roller diameter due to heat, a conveying speed imported to the recording medium by the transferring portion and a conveying speed imported to the recording medium by the fixing portion become different from each other. In this case, the recording medium is pulled at both the transferring portion and the fixing portion, or a loop larger than necessary occurs to the recording medium, which may lead to deterioration in image quality.

In order to solve the above-mentioned problem, a method has been adopted in which a detection portion is provided to detect an amount of loop that is formed in the recording medium by the transferring portion and the fixing portion, and the plural conveyor portions such as the rollers are controlled to maintain the amount of loop formed in the recording medium by the transferring portion and the fixing portion at a given level.

However, in the conventional image forming apparatus, the recording medium is passed through the transferring portion while maintaining a given amount of loop formed in the recording medium, so that there arises another problem as follows. That is, when a trailing end of the recording medium passes through the transferring portion, the loop formed by the plural conveyor portions such as the rollers is released. As a result, the trailing end of the recording medium vibrates, and the unfixed toner image that has been transferred onto the paper is disturbed, which leads to the deterioration in image quality.

SUMMARY OF THE INVENTION

The present invention has been made in view of the above-mentioned problems, and therefore has an object to provide an improved image forming apparatus and method.

Further, the object of the present invention is to provide an image forming apparatus including: a transferring portion that transfers a toner image formed on an image bearing member onto a recording medium at a transfer position; a fixing portion that fixes the toner image transferred onto the recording medium; and a control portion that controls a fixing/conveying speed at which the fixing portion conveys the recording medium, to thereby control an amount of loop formed in the recording medium by the transferring portion and the fixing portion, in which, in response to a fact that a trailing end of the recording medium has reached a predetermined position on an upstream side of the transfer position in a conveying direction, the fixing/conveying speed is controlled to reduce the amount of loop.

Other objects of the present invention will become apparent upon reading the following detailed descriptions with reference to the accompanying drawings.

DESCRIPTION OF THE PREFERRED EMBODIMENTS

Hereinafter, an image forming apparatus according to embodiments of the present invention will be described with reference to the drawings.

Embodiment 1

Embodiment 1 will be described using FIGS. 1 to 4.

Figure 1:
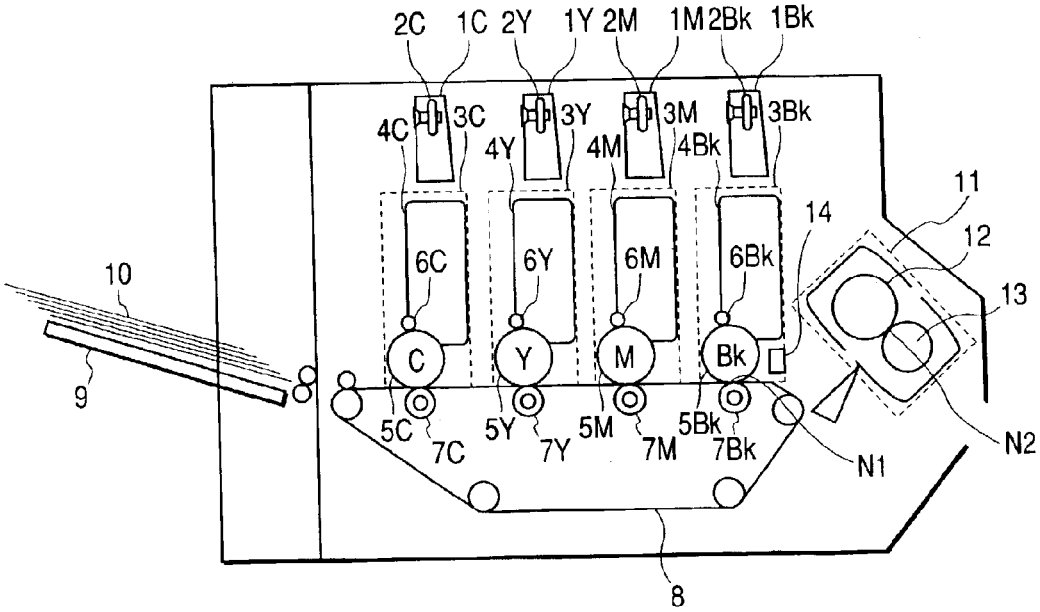
FIG. 1 shows an overall structure of a tandem-type color image forming apparatus.

FIG. 1 shows an overall structure of a tandem-type color image forming apparatus. In the tandem-type color image forming apparatus described in Embodiment 1, developers (toners) for cyan (C), yellow (Y), magenta (M), and black (K) are transferred onto a recording medium and fixed thereto by using an electrophotographic system, to thereby form an image.

Reference symbols 1C, 1Y, 1M, and 1Bk denote scanner units that are constructed by semiconductor lasers (not shown) and rotary polygon mirrors 2C, 2Y, 2M, and 2Bk, respectively.

Reference symbols 3C, 3Y, 3M, and 3Bk denote cartridges, each of which is integrally constructed by a developer storage device 4, a photosensitive member 5, a developing sleeve 6, and the like, which will be described later, so as to be attachable to and detachable from an image forming apparatus main body. Note that structural arrangement of the respective cartridges is not limited to that shown in FIG. 1, and may be in arbitrary order.

Reference symbols 4C, 4Y, 4M, and 4Bk denote developer storage devices that store developers (toners), and clean residual toners off photosensitive members 5C, 5Y, 5M, and 5Bk, respectively, to thereby recover waste toners.

Reference symbols 6C, 6Y, 6M, and 6Bk denote developing sleeves that are charged by electrostatic charging devices (not shown), and supply toners onto the photosensitive members 5C, 5Y, 5M, and 5Bk, respectively, on which electrostatic latent images have been formed by irradiating laser light from the scanner units 1C, 1Y, 1M, and 1Bk, respectively. Thus, a toner image is developed on the photosensitive member.

Reference symbols 7C, 7Y, 7M, and 7Bk denote transferring rollers that serve to transfer the toner image onto a recording medium 10. More specifically, a cartridge driving motor described later imparts a rotational force to the photosensitive member. Then, the recording medium is nipped and conveyed by the photosensitive member and the transferring roller, while the toner image developed on the photosensitive member is transferred onto the recording medium.

Reference numeral 8 denotes a conveyor belt which is formed into an endless shape and serves to transfer the recording medium; 9, a sheet feeding unit; and 10, a recording medium.

Note that a conveying force is importioned to the recording medium 10 by the photosensitive member 5Bk located at the most downstream in a conveying direction, the transferring roller 7Bk, and the conveyor belt 8, so that the recording medium 10 is sent to a fixing unit 11.

The fixing unit 11 serves to fix the toner image to the recording medium, and is composed of a heating roller 12 that heats the recording medium and a pressure roller 13 that conveys the recording medium while imparting a rotational force to the heating roller 12 and pressurizing the heating roller 12. Note that, as the heating roller 12, there are used an electromagnetic induction heating apparatus in which a coil is disposed within a film-shaped electromagnetic induction heating rotary member and due to an electric current made to flow in the coil, the film-shaped electromagnetic induction heating rotary member on the outer periphery is heated, an apparatus with a heat source such as a halogen heater built thereinto, and the like.

Reference numeral 14 denotes a recording medium detection sensor that is provided on an upstream side of the fixing unit 11 in the conveying direction. Note that, in this embodiment, the recording medium detection sensor 14 is provided in the conveying direction on a downstream side of the cartridge 3Bk that is located at the most downstream in the conveying direction, but may be provided in an arbitrary position-on the upstream side of the fixing unit 11 in the conveying direction.

Figure 2:
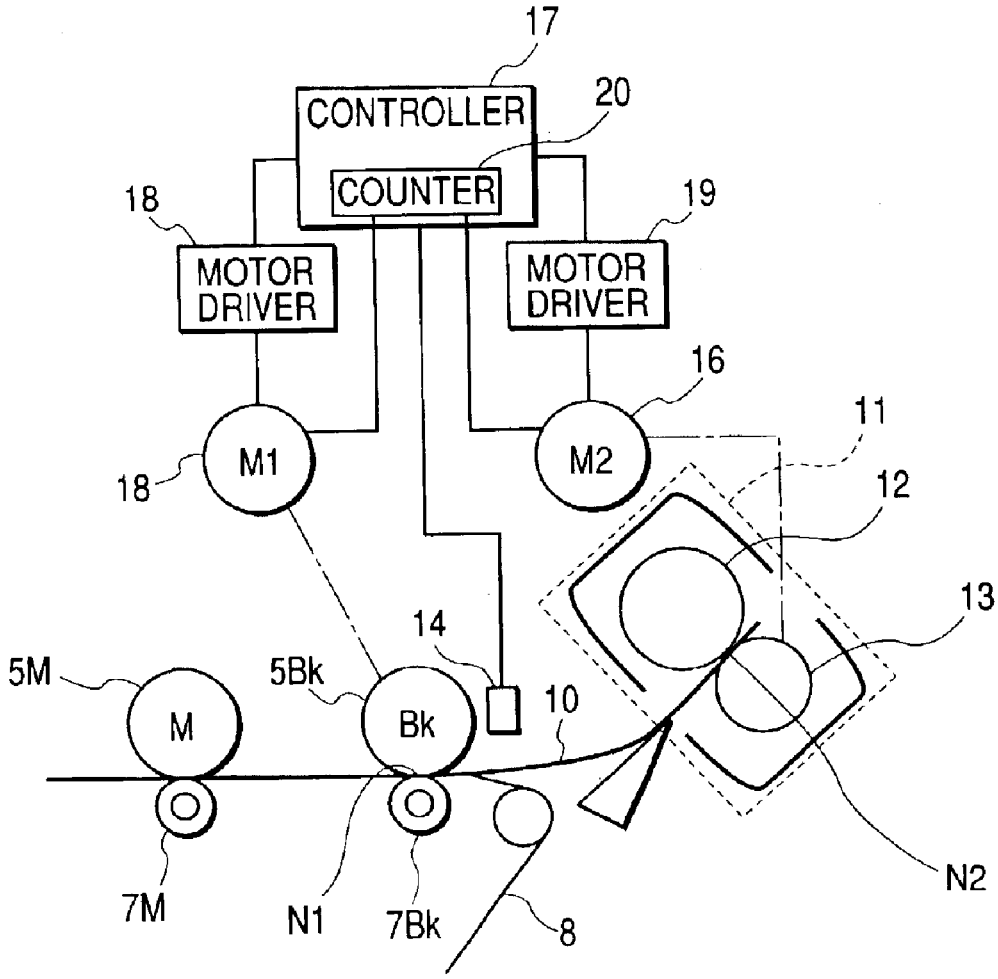
FIG. 2 is an enlarged view showing a main portion of the tandem-type color image forming apparatus.

FIG. 2 is an enlarged view showing a main portion of FIG. 1 which specifies the following structural elements in addition to those in FIG. 1. That is, there are shown: a cartridge driving motor 15 that drives the cartridge 3Bk including the photosensitive member 5Bk and located at the most downstream side among the cartridges 3C, 3Y, 3M, and 3Bk in the conveying direction; a fixing unit driving motor 16 that drives the pressure roller 13 of the fixing unit 11; a controller 17 that controls drive of the motors; motor drivers 18 and 19 that serve to drive the above motors in response to a control command from the controller 17; and a counter 20 that counts pulses from a pulse generating apparatus (encoder, MR sensor, or the like) which generates pulses in accordance with rotation of a motor. Note that the controller 17 is composed of a CPU and the like, and may also be structured such that the counter 20 is provided aside from the CPU or the counter 20 is built into the CPU. Also, the cartridge driving motor 15 may be provided for each of the cartridges 3C, 3Y, 3M, and 3Bk or may be provided to all of the cartridges in common.

Figure 3:
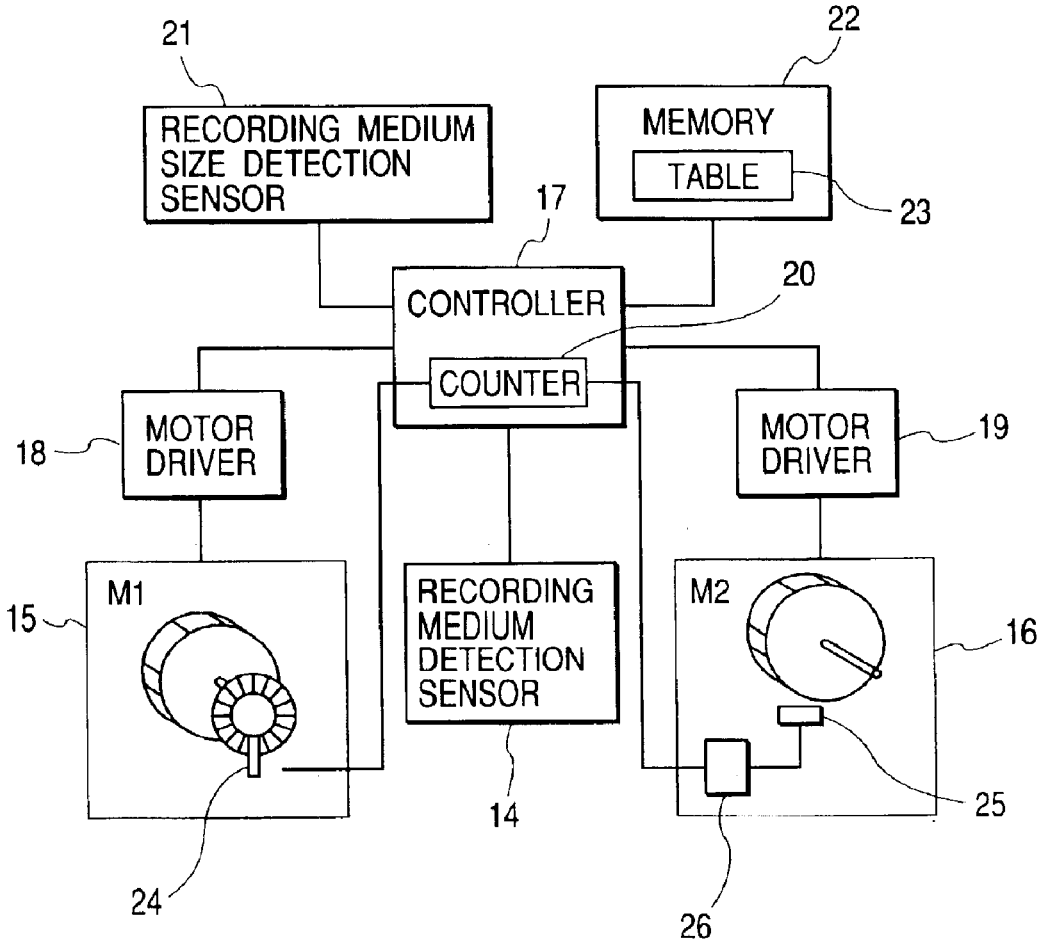
FIG. 3 is a control block diagram of an image forming apparatus.

FIG. 3 is a control block diagram in Embodiment 1.

Reference numeral 21 denotes a recording medium size detection sensor that detects a size of a recording medium 10 among a sheet stack in the sheet feeding unit 9. Reference numeral 22 denotes a memory including a Table 23 that stores count values in accordance with the size of the recording medium 10 which are used when counting at the counter 20. Note that the count values stored in the Table 23 include a count value C1 and a count value C1*d*. The count value C1 is counted by the counter 20 after a leading end of the recording medium 10 conveyed at a process speed Vp is detected by the recording medium detection sensor 14 until a trailing end of the recording medium 10 has been passed through a transfer nip portion N1 at which the photosensitive member 5Bk and the transferring roller 7Bk are approximated to each other. The count value C1*d* is counted by the counter 20 after the leading end of the recording medium 10 is detected by the recording medium detection sensor 14 until the process speed has been reduced to a process speed Vpd lower than Vp.

Reference numeral 24 denotes an encoder that is mounted to a drive shaft of the cartridge driving motor 15 and composed of a disk having equally spaced slits along its circumference and a photo interrupter. When light from the photo interrupter is transmitted through the slit of the disk, the encoder 24 outputs pulses to the counter 20. Thus, based on a value of the counter 20, the controller 17 calculates a conveyed distance of the recording medium 10 conveyed by the photosensitive member 5Bk that is driven by the cartridge driving motor 15, thereby being capable of judging whether or not the trailing end of the recording medium 10 has reached a predetermined position on the upstream side of the transfer nip portion N1 in the conveying direction.

Reference numeral 25 denotes a ferromagnetic magnetoresistance effect type sensor element (hereinafter, referred to as MR sensor) that detects a pattern in which a rotor of the fixing unit driving motor 16 has been uniformly magnetized and outputs the detected pattern to a waveform converter 26 as a sine waveform corresponding to a rotational speed of the rotor. The waveform converter 26 converts the sine waveform into a rectangular pulse wave (for example, 360 pulses/rotation) and outputs the obtained rectangular pulse wave to the counter 20.

Then, based on the count values of the pulses outputted from the motor, the controller 17 can calculate the conveying speed importioned to the recording medium 10 by the photosensitive member 5Bk, the transferring roller 7Bk, and the conveyor belt 8 and the conveying speed importioned to the recording medium 10 by the fixing unit 11. In addition, by comparing the measured count value with the count value stored in advance in the table 23, the controller 17 can calculate the conveying position of the recording medium 10. After that, based on the calculated conveying speed and conveying position, the control command is sent to the motor drivers 18 and 19 to control the cartridge driving motor 15 and the fixing unit driving motor 16.

Figure 4:
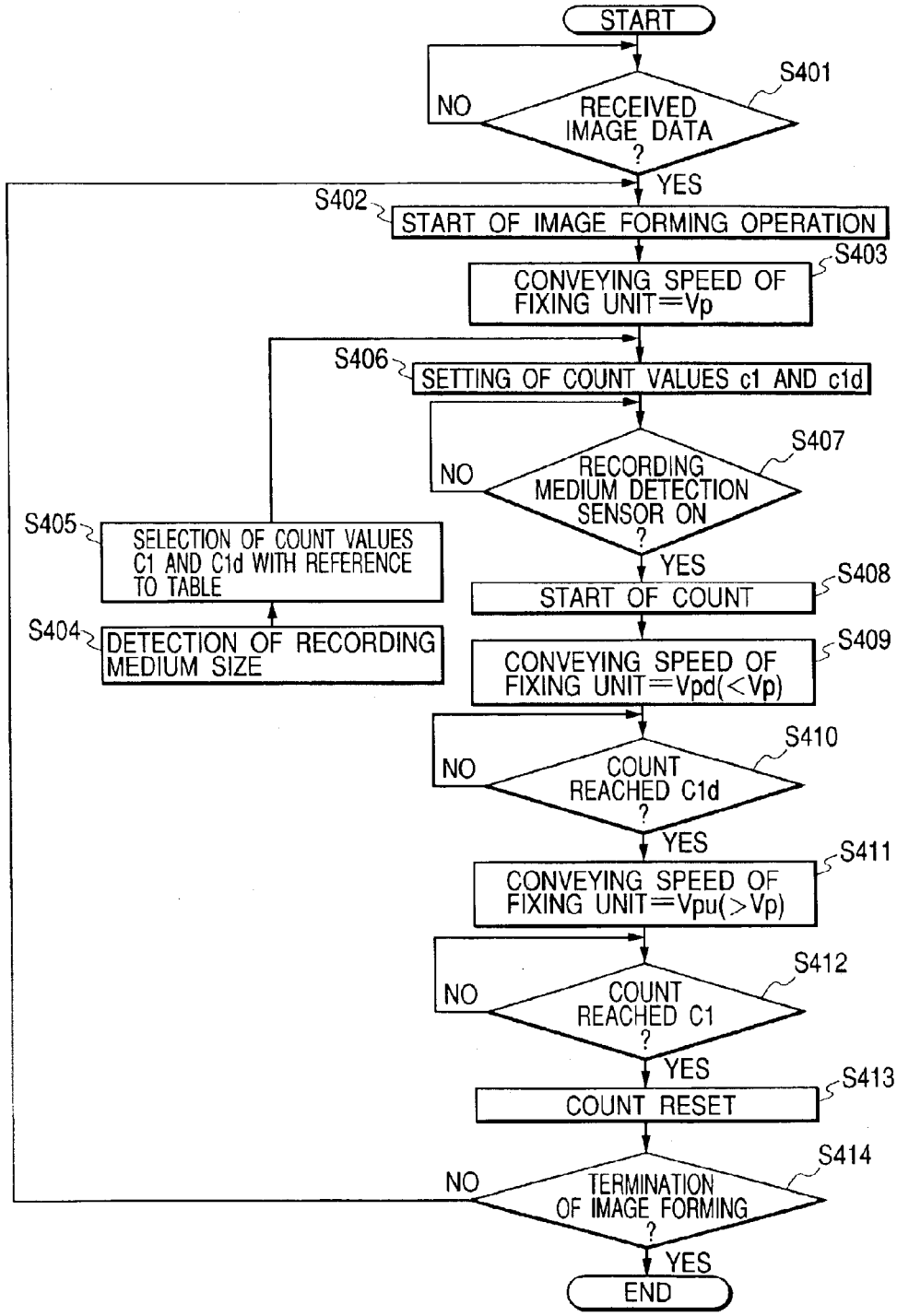
FIG. 4 is a flowchart for explaining Embodiment 1.

Next, an operation of the image forming apparatus according to this embodiment will be described using the flowchart shown in FIG. 4.

In step S401, the controller 17 monitors whether or not image data sent from a video controller (not shown) or the like is received.

In step S402, in response to the fact that the image data has been received ("YES" in step S401), an image forming operation starts, while the recording medium 10 among the sheet stack in the sheet feeding unit 9 that is specified as a sheet feeding port by the video controller, an operation panel, or the like is fed by a sheet feeding roller (not shown).

In step S403, the conveying speed of the fixing unit 11 is set to the process speed Vp. The process speed Vp is a conveying speed of an image forming portion constituted of the cartridges 3C, 3Y, 3M, and 3Bk, the transferring rollers 7C, 7Y, 7M, and 7Bk, the conveyor belt 8, and the like, in which the toner images on the photosensitive members 5C, 5Y, 5M, and 5Bk are transferred. This operation is performed by sending the control command from the controller 17 to the motor driver 18 and controlling the rotational speed of the cartridge driving motor 15. Note that, the fed recording medium 10 is conveyed at the process speed Vp. Concurrently, when the recording medium 10 is passed through the cartridge 4C, a toner image in C (cyan) formed on the photosensitive member 5C is transferred thereonto. After that, a toner image in Y (yellow), a toner image in M (magenta), and a toner image in Bk (black) are sequentially transferred in order along the conveying direction by means of the cartridges 4Y, 4M, and 4Bk, respectively. Finally, a full-color toner image is transferred.

Steps S404 and S405 are executed in parallel with steps S402 and S403. In step S404, a recording medium size is detected by the recording medium size detection sensor 21. In step S405, the detected recording medium size is compared with Table 23 within the memory 22 and the count values C1 and C1*d* that are appropriate for the size are selected.

Note that the count value C1 is the value that is counted by the counter 20 after the leading end of the recording medium 10 conveyed at the process speed Vp is detected by the recording medium detection sensor 14 until the trailing end of the recording medium 10 has been passed through the transfer nip portion N1 at which the photosensitive member 5Bk and the transferring roller 7Bk are approximated to each other. The count value C1*d* is about half the count value C1 and corresponds to a time after the leading end of the recording medium 10 is detected by the recording medium detection sensor 14 until an intermediate position of a length of the recording medium 10 in the conveying direction has reached the transfer nip portion N1.

In step S406, the count values C1 and C1*d* selected in step S405 are set in the controller 17.

In step S407, the controller 17 judges whether or not the recording medium 10 onto which the full-color toner image has been transferred is conveyed to reach the recording medium detection sensor 14 and an output of the sensor is turned on.

In step S408, in response to the fact that the leading end of the recording medium 10 is detected ("YES" in step S407), the counter 20 starts to count output pulses of the cartridge driving motor 15.

In step S409, the controller 17 sends a deceleration command to the motor driver 19, reduces the number of rotation of the fixing unit driving motor 16, and sets the conveying speed of the fixing unit 11 to Vpd lower than the process speed Vp. Vpd can be set to an arbitrary value as long as Vpd is lower than the process speed Vp. In this embodiment, as an example, Vpd is assumed to be a speed of 95% of Vp, that is, Vpd=0.95 Vp.

In step S410, the controller 17 monitors whether or not the count started in step S408 has reached C1*d*, to thereby judge whether the trailing end of the recording medium 10 has reached the predetermined position on the upstream side of the transfer nip portion N1 in the conveying direction. If the count has reached C1*d*, in step S411, a acceleration command is sent from the controller 17 to the motor driver 19, the number of rotations of the fixing unit driving motor 16 is increased, and the conveying speed of the fixing unit 11 is set to the process speed Vpu higher than the process speed Vp. Vpu can be set to an arbitrary value as long as Vpu is higher than the process speed Vp. Assuming that the normal process speed is Vp, the time for passing the recording medium 10 through the fixing unit 11 at the process speed Vp is T, and the time for conveying the recording medium 10 by the fixing unit 11 at the low speed Vpd is Td, Vpu is preferably set to the speed represented by the following expression.

$$Vpu=(Vp\cdot T-Vpd\cdot Td)/(T-Td) \quad \text{(Expression 1)}$$

By determining Vpu as described above, the fixing unit driving motor 16 is controlled such that a mean value of the speed at which one recording medium is passed through the fixing unit becomes the process speed Vp. Thus, the recording medium 10 is finally discharged from the fixing unit 11 at the same timing as the case where an image is formed on the recording medium 10 at the process speed Vp without any change in speed.

In step S412, it is monitored whether the count has reached C1. If the count has reached C1, the count is reset in step S413.

In step S414, it is judged whether or not the subsequent page on which an image is to be formed exists. If the subsequent page on which an image is to be formed exists, the operation returns to step S402. If no subsequent page exists, the image forming operation ends.

Hereinafter, conveyed states of the recording medium 10 in the above-mentioned operation are described with reference to FIGS. 11A to 11C.

Figure 11A:
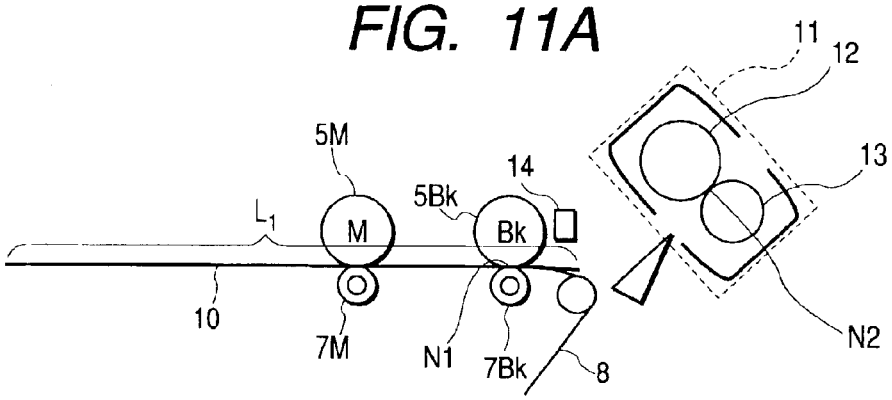
FIGS. 11A, 11B and 11C are explanatory views showing temporal variation in conveyance of a recording medium.

FIG. 11A shows a conveyed state of the recording medium 10 at the time point when the leading end of the recording medium 10 is detected by the recording medium detection sensor 14. As shown in step S409 of the flowchart shown in FIG. 4, the controller 17 at this time point reduces the conveying speed of the fixing unit 11 from the process speed Vp to Vpd lower than Vp.

Figure 11B:
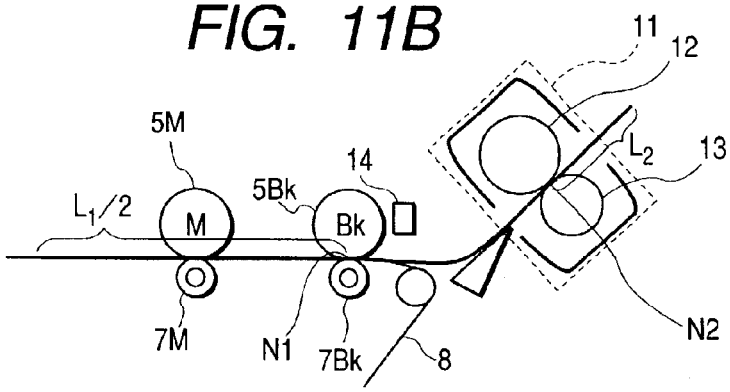

FIG. 11B shows the state in which, after entering a fixing nip portion N2, the leading end of the recording medium 10 has been conveyed by a distance corresponding to $L_2$ (=Vpd·Td) by means of the fixing unit 11. Vpd is a speed lower than the process speed Vp and the distance by which the recording medium 10 is conveyed by the fixing unit 11 at the process speed Vp for Td is Vd·Td. Accordingly, in the recording medium 10 between the transfer nip portion N1 and the fixing nip portion N2, a loop corresponding to (Vp·Td−Vpd·Td) is formed.

Note that, at this time point, the distance from the transfer nip portion N1 to the trailing end of the recording medium 10 is half the length $L_1$ of the recording medium 10 in the conveying direction. Then, the conveying speed of the fixing unit 11 is changed over from Vpd to Vpu higher than Vp, so that the loop formed between the transfer nip portion N1 and the fixing nip portion N2 at this time point is reduced when the trailing end of the recording medium 10 is passed through the transfer nip portion N1.

Figure 11C:
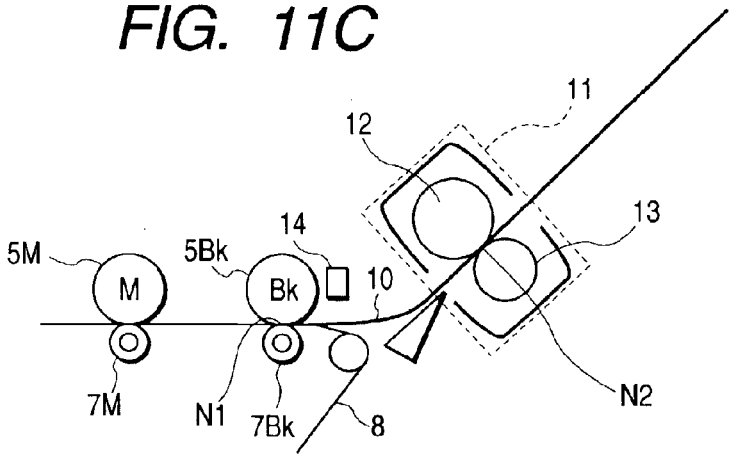

FIG. 11C shows the conveyed state of the recording medium 10 at the time point when the trailing end of the recording medium 10 has reached the transfer nip portion N1.

As described above, by setting Vpu, the loop corresponding to (Vp·Td−Vpd·Td) formed in FIG. 11B has been eliminated in the state of FIG. 11C in which the recording medium 10 has been conveyed by $L_1/2$ from the state of FIG. 11B. Therefore, vibration of the trailing end of the recording medium 10 can be suppressed when the trailing end of the recording medium 10 is passed through the transfer nip portion N1.

Note that, in Embodiment 1, the encoder 24 is used for detecting the rotational speed of the cartridge driving motor 15 and the MR sensor is used for detecting the rotational speed of the fixing unit driving motor 16. However, one of the encoder 24 and the MR sensor may be used for both motors. Also, if a stepping motor is used as the motor, there may be employed a structure such that the same control is performed using a method in which drive pulses sent to the motor driver by the controller 17 in order to drive the stepping motor are counted by the counter 20.

In Embodiment 1, the value of C1*d* is set such that, after the recording medium detection sensor 14 detected the recording medium 10, in response to the fact that the recording medium 10 has been conveyed by ½ of its length in the conveying direction, the conveying speed of the fixing unit 11 is changed over from Vpd to Vpu. However, an arbitrary length from ⅓ to ¾ of the length of the recording medium 10 in the conveying direction may be set as the basis of the changeover. For example, "⅓" mentioned above indicates the state in which the distance from the transfer nip portion N1 to the trailing end of the recording medium 10 equals to ⅓ of the length of the recording medium 10 in the conveying direction.

In Embodiment 1, the recording medium detection sensor 14 that detects the recording medium 10 is disposed between the transfer nip portion N1 and the fixing nip portion N2, and can be disposed in an arbitrary position as long as the position is on the upstream side of the fixing nip portion N2 in the conveying direction. In this case, the count value C1 stored in the table 23 of the memory 22 differs from the above-mentioned value, and is a value counted by the counter 20 after the recording medium detection sensor 14 detects the leading end of the recording medium 10 until the trailing end of the recording medium 10 has been passed through the transfer nip portion N1. Also, the count value C1*d* is set to the count value that is necessary after the leading end of the recording medium 10 is detected by the recording medium detection sensor 14 until the state has been reached in which the distance from the transfer nip portion N1 to the trailing end of the recording medium 10 is a predetermined distance (for example, ½ of the length of the recording medium 10 in the conveying direction).

As described above, there can be provided an image forming apparatus in which, in accordance with the conveying position of the recording medium 10 calculated by the controller 17, the control mode is changed over from a mode for controlling to form a loop to a mode for controlling to reduce the amount of loop. As a result, no image defect occurs due to variation of the roller diameter of the fixing unit 11 or the like. In addition, no image defect occurs due to bounce of the trailing end of the recording medium 10 when passing through the transferring portion.

Embodiment 2

Embodiment 2 will be described using FIGS. 5A to 5D, 6A, 6B, 7A and 7B.

In Embodiment 1, after the recording medium detection sensor 14 detects the recording medium 10, the conveying speed of the fixing unit 11 is controlled to be changed over in accordance with the count value. Instead, in Embodiment 2, there is provided a process in which a sensor that detects the amount of loop formed in the recording medium 10 by the transferring portion and the fixing unit 11 is further used to thereby control the amount of loop to be maintained at a given level.

FIGS. 5A to 5D show temporal variation in conveyance of the recording medium 10 in Embodiment 2. Reference numeral 27 denotes a loop detection sensor that detects whether or not the amount of loop formed by the transferring portion, in which the photosensitive member 5Bk and the transferring roller 7Bk are approximated to each other, and the fixing unit 11 has reached a given amount. Note that, as shown in FIGS. 6A and 6B, the loop detection sensor 27 is composed of a mechanical flag 28 and a photo interrupter 29. When a loop is formed in the recording medium 10, a recording medium contacting member 28*a* included in the mechanical flag 28 is forced by the recording medium 10, to thereby rotate the mechanical flag 28. Concurrently, a shielding member 28*b* that is shielding the photo interrupter 29 (the loop detection sensor is off as shown in FIG. 6A) is rotated to release the shielding (the loop detection sensor is on as shown in FIG. 6B). Thus, the output of the loop detection sensor 27 is reversed, so that it is detected that the given amount of loop has been formed.

Figure 7:
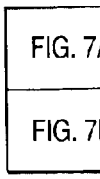
FIGS. 7A and 7B are flowcharts for explaining Embodiment 2.
Figure 7A:
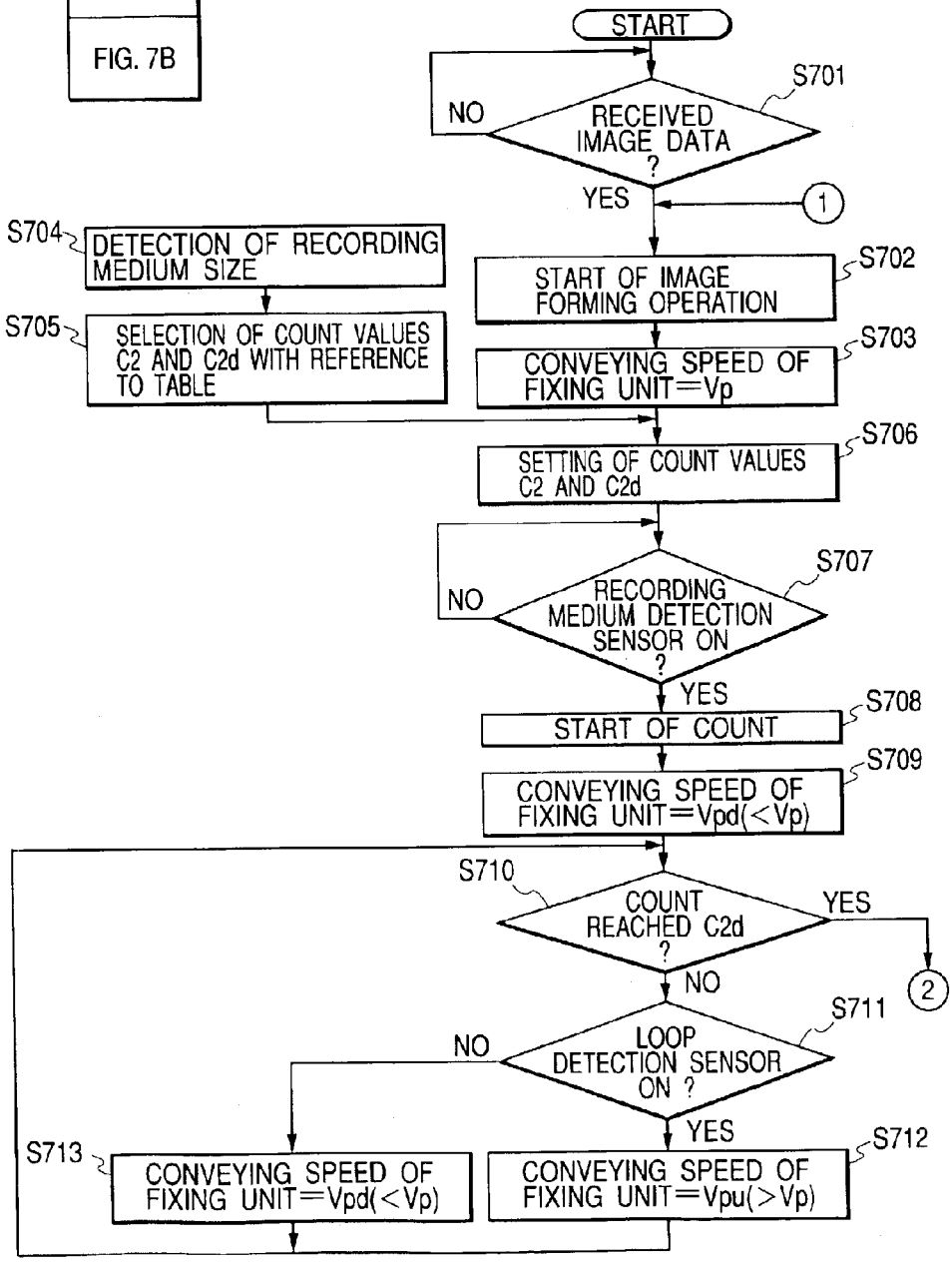
Figure 7B:
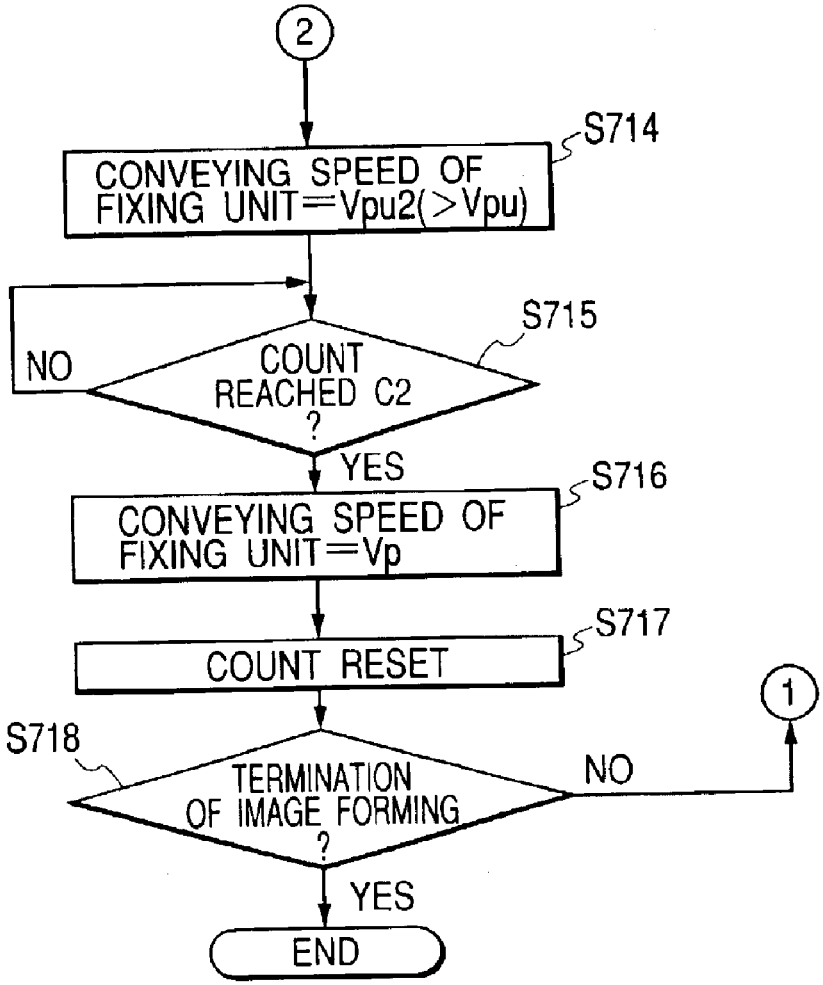

Next, an operation of the image forming apparatus according to Embodiment 2 will be described using the flowchart shown in FIGS. 7A and 7B.

Steps S701 to S704 are identical to steps S401 to S404 in Embodiment 1, so that their description will be omitted.

In step S705, a count value C2 and a count value C2*d* are selected based on the recording medium size detected in step S704 with reference to the table 23. C2 is the value that is counted by the counter 20 after the leading end of the recording medium 10 conveyed at the process speed Vp is detected by the recording medium detection sensor 14 until the trailing end of the recording medium 10 has been passed through the transfer nip portion N1 at which the photosensitive member 5Bk and the transferring roller 7Bk are approximated to each other. C2*d* is the value that is counted by the counter 20 after the leading end of the recording medium 10 is detected by the recording medium detection sensor 14 until a sufficient amount of loop has been formed in the recording medium 10 that is conveyed at the process speed Vp, and may be smaller than C2. However, C2*d* is preferably set to the value counted by the counter 20 after the leading end of the recording medium 10 is detected by the recording medium detection sensor 14 until ⅓ to ¾ of the length of the recording medium 10 in the conveying direction has been left to be conveyed. For example, "⅓" mentioned above indicates the state in which the distance from the transfer nip portion N1 to the trailing end of the recording medium 10 equals to ⅓ of the length of the recording medium 10 in the conveying direction.

In step S706, the count values C2 and C2*d* selected in step S705 are set in the controller 17. In step S707, it is monitored whether or not the recording medium 10 onto which the full-color image is transferred has been passed through the image forming portion, and the recording medium detection sensor 14 detects the leading end of the recording medium 10 to turn on the output thereof.

In step S708, in response to the fact that the leading end of the recording medium 10 is detected ("YES" in step S407; in the state of FIG. 5A), the counter 20 starts to count the output pulses of the cartridge driving motor 15.

In step S709, the controller 17 sends a deceleration command to the motor driver 19, reduces the number of rotation of the fixing unit driving motor 16, and sets the conveying speed of the fixing unit 11 to Vpd lower than the process speed Vp. Vpd can be set to an arbitrary value as long as Vpd is lower than the process speed Vp. Similarly to Embodiment 1, Vpd is assumed to be the speed of 95% of Vp, that is, Vpd=0.95 Vp.

In step S710, the controller 17 monitors whether or not the count started in step S708 has reached C2*d*. If the count has not reached C2*d*, the operation advances to step S711.

In step S711, the output of the loop detection sensor is monitored. If the loop detection sensor is on, the operation advances to step S712. If the loop detection sensor is off, the operation advances to step S713.

In step S712, under the judgment that the loop has been formed (the state of FIG. 5C, etc.), the controller 17 sends a acceleration command to the motor driver 19, increases the number of rotation of the fixing unit driving motor 16, and sets the conveying speed of the fixing unit 11 to Vpu higher than the process speed Vp, to thereby control to reduce the amount of loop. Note that Vpu can be set to an arbitrary value as long as Vpu is higher than the process speed Vp. However, Vpd is assumed to be calculated by the same expression as in Embodiment 1.

In step S713, under the judgment that the amount of loop has been reduced (the state of FIG. 5B, etc.), the controller 17 sends a deceleration command to the motor driver 19, reduces the number of rotation of the fixing unit driving motor 16, and sets the conveying speed of the fixing unit 11 to Vpd, to thereby form the loop.

After steps S712 and S713 end, the operation returns to step S710 and it is again monitored whether the count has reached C2*d*. If the count has reached C2*d*, the operation advances to step S714. At this time point, the recording medium 10 is being conveyed by both the image forming portion and the fixing unit 11 so as to maintain the given amount of loop, and the trailing end of the recording medium 10 is located at the upstream of the transfer nip portion N1 in the conveying direction. At the transfer nip portion N1, the photosensitive member 5Bk and the transferring roller 7Bk which are located at the most downstream in the image forming portion are approximated to each other.

Then, in step S714, in order that the amount of loop when the trailing end of the recording medium 10 is passed through the transfer nip portion N1 becomes an adequate amount (the state of FIG. 5D), the controller 17 sets the conveying speed of the fixing unit 11 to Vpu2 higher than Vpu, to thereby control to reduce the amount of loop. Vpu2 can be set to an arbitrary value as long as Vpu2 is higher than Vpu. Assuming that the normal process speed is Vp, the time for passing the recording medium 10 through the fixing unit 11 at the process speed Vp is T, the time for conveying the recording medium 10 by the fixing unit 11 at the high speed Vpu is Tu, and the time for conveying the recording medium 10 by the fixing unit 11 at the low speed Vpd is Td, Vpu2 is preferably set to the speed represented by the following expression.

$$Vpu2=[Vp\cdot T-(Vpu\cdot Tu+Vpd\cdot Td)]/(T-Tu-Td) \quad \text{(Expression 2)}$$

In step S715, it is judged whether or not the trailing end of the recording medium 10 has been passed through the transferring portion according to whether or not the count has reached C2. If the count has reached C2, the operation advances to step S716 and the conveying speed of the fixing unit is returned to Vp.

After that, in step S717, the count of the counter 20 is reset. In step S718, it is judged whether or not the subsequent page on which an image is to be formed exists. If the subsequent page on which an image is to be formed exists, the operation returns to step S702. If no subsequent page exists, the image forming operation ends.

Hereinafter, conveyed states of the recording medium 10 in the above-mentioned operation are described with reference to FIGS. 5A to 5D.

Figure 5A:
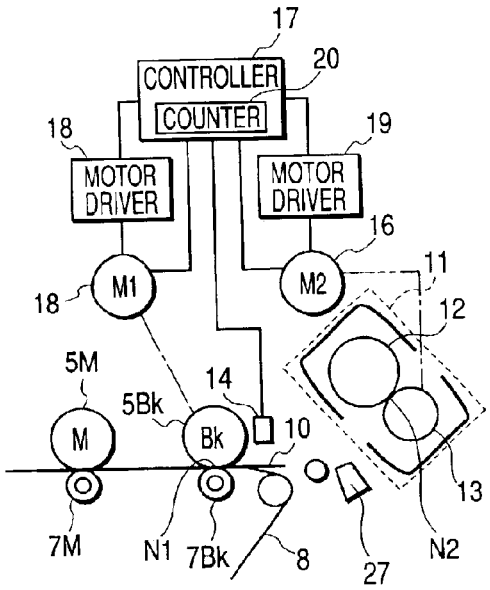
FIGS. 5A, 5B, 5C and 5D are explanatory views showing temporal variation in conveyance of a recording medium.
Figure 5B:
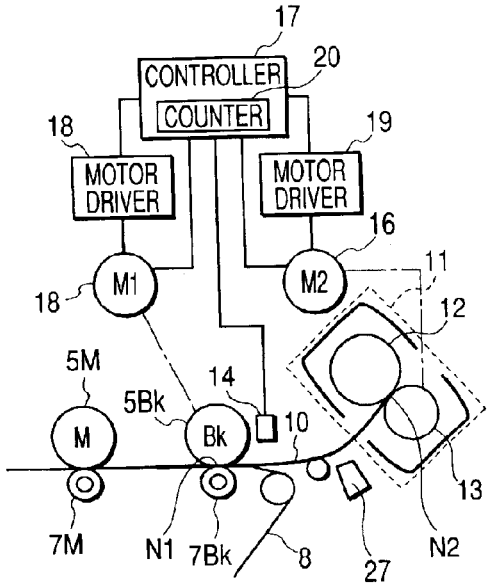
Figure 6A:
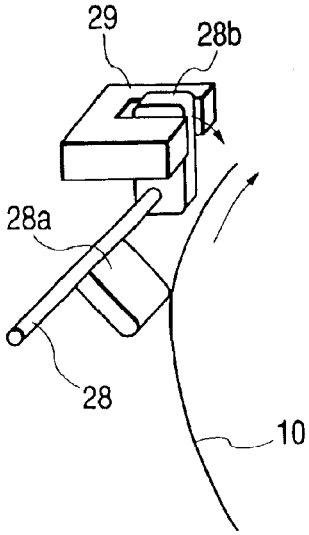
FIGS. 6A and 6B are explanatory views showing an operation of a loop detection sensor.
Figure 6B:
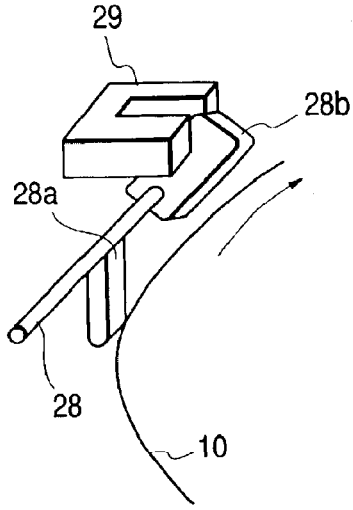

FIG. 5A shows a conveyed state of the recording medium 10 at the time point when the leading end of the recording medium 10 is detected by the recording medium detection sensor 14. As shown in step S709 of the flowchart shown in FIGS. 7A and 7B, the controller 17 at this time point reduces the conveying speed of the fixing unit 11 from the process speed Vp to Vpd lower than Vp. After that, in accordance with an on state (with a loop)/an off state (without a loop) of the loop detection sensor 27, Vpd and Vpu are changed over while conveying the recording medium 10.

Figure 5C:
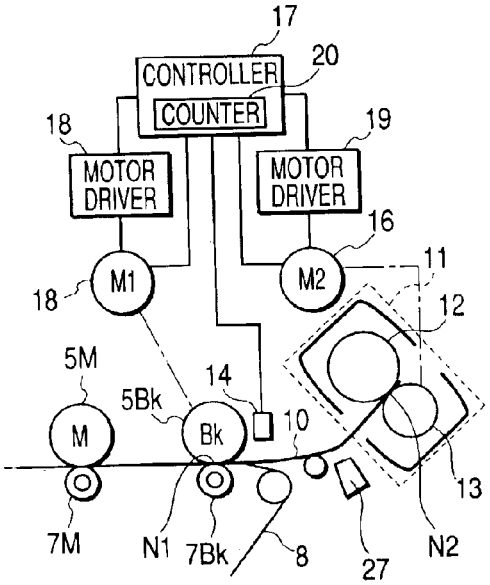

FIG. 5C shows the state in which, after entering the fixing nip portion N2, the leading end of the recording medium 10 has been conveyed by a distance corresponding to (Vpu·Tu+Vpd·Td) by means of the fixing unit 11. In steps S710 to S713, Vpu and Vpd are changed over while conveying the recording medium 10. The total amount of time when the recording medium 10 is conveyed at Vpu is Tu, and the total amount of time when the recording medium 10 is conveyed at Vpd is Td. The distance by which the recording medium 10 is conveyed at the process speed Vp for (Tu+Td) is Vpu·(Tu+Td), so that a loop corresponding to [Vp·(Tu+Td)−(Vpu·Tu+Vpd·Td)] is formed.

Then, the conveying speed of the fixing unit 11 is changed over to Vpu2 higher than Vpu, so that the loop formed between the transfer nip portion N1 and the fixing nip portion N2 is reduced when the trailing end of the recording medium 10 is passed through the transfer nip portion N1.

Figure 5D:
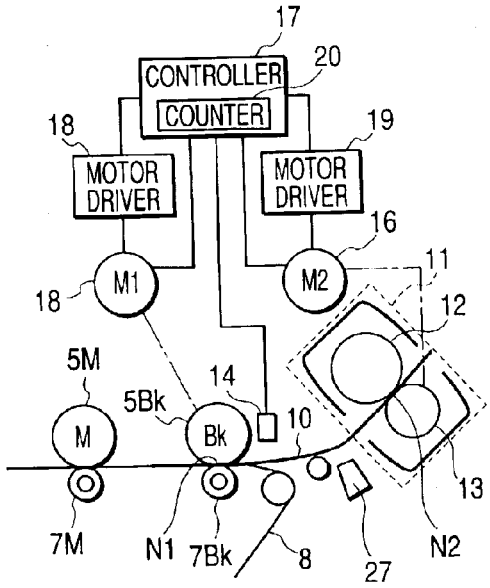

FIG. 5D shows the conveyed state of the recording medium 10 at the time point when the trailing end of the recording medium 10 has reached the transfer nip portion N1.

As described above, by setting Vpu2, the loop corresponding to [Vp·(Tu+Td)−(Vpu·Tu+Vpd·Td)] formed in FIG. 5C has been eliminated. Therefore, vibration of the trailing end of the recording medium 10 can be suppressed when the trailing end of the recording medium 10 is passed through the transfer nip portion N1.

In Embodiment 2, the recording medium detection sensor 14 that detects the recording medium 10 is disposed between the transfer nip portion N1 and the fixing nip portion N2, and can be disposed in an arbitrary position as long as the position is on the upstream side of the fixing nip portion N2 in the conveying direction. In this case, the count values C2 and C2*d* to be stored in Table 23 of the memory 22 differ from the above-mentioned values. However, C2 still may be the value that is counted after the leading end of the recording medium 10 conveyed at the process speed Vp is detected by the recording medium detection sensor 14 until the trailing end of the recording medium 10 has been passed through the transfer nip portion N1 at which the photosensitive member 5Bk and the transferring roller 7Bk are approximated to each other. Also, C2*d* may still be the value that is counted by the counter 20 after the leading end of the recording medium 10 is detected by the recording medium detection sensor 14 until a sufficient amount of loop has been formed in the recording medium 10 that is conveyed at the process speed Vp.

As described above, there can be provided an image forming apparatus in which, in accordance with the conveying position of the recording medium 10 calculated by the controller 17, the control mode is changed over from the mode for controlling to form a given amount of loop to the mode for controlling to reduce the amount of loop. As a result, no image defect occurs due to variation of the roller diameter of the fixing unit 11 or the like. In addition, no image defect occurs due to bounce of the trailing end of the recording medium 10 when passing through the transferring portion.

There can also be provided an image forming apparatus in which, by controlling the mean value of the conveying speed per one recording medium 10 to be the process speed Vp, the amount of loop when the trailing end of the recording medium 10 is passed through the transferring portion becomes an adequate amount. As a result, no image defect occurs due to bounce of the trailing end of the recording medium 10.

Embodiment 3

Figure 8:
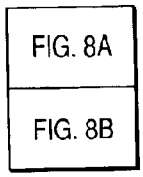
FIGS. 8A and 8B are flowcharts for explaining Embodiment 3.
Figure 8A:
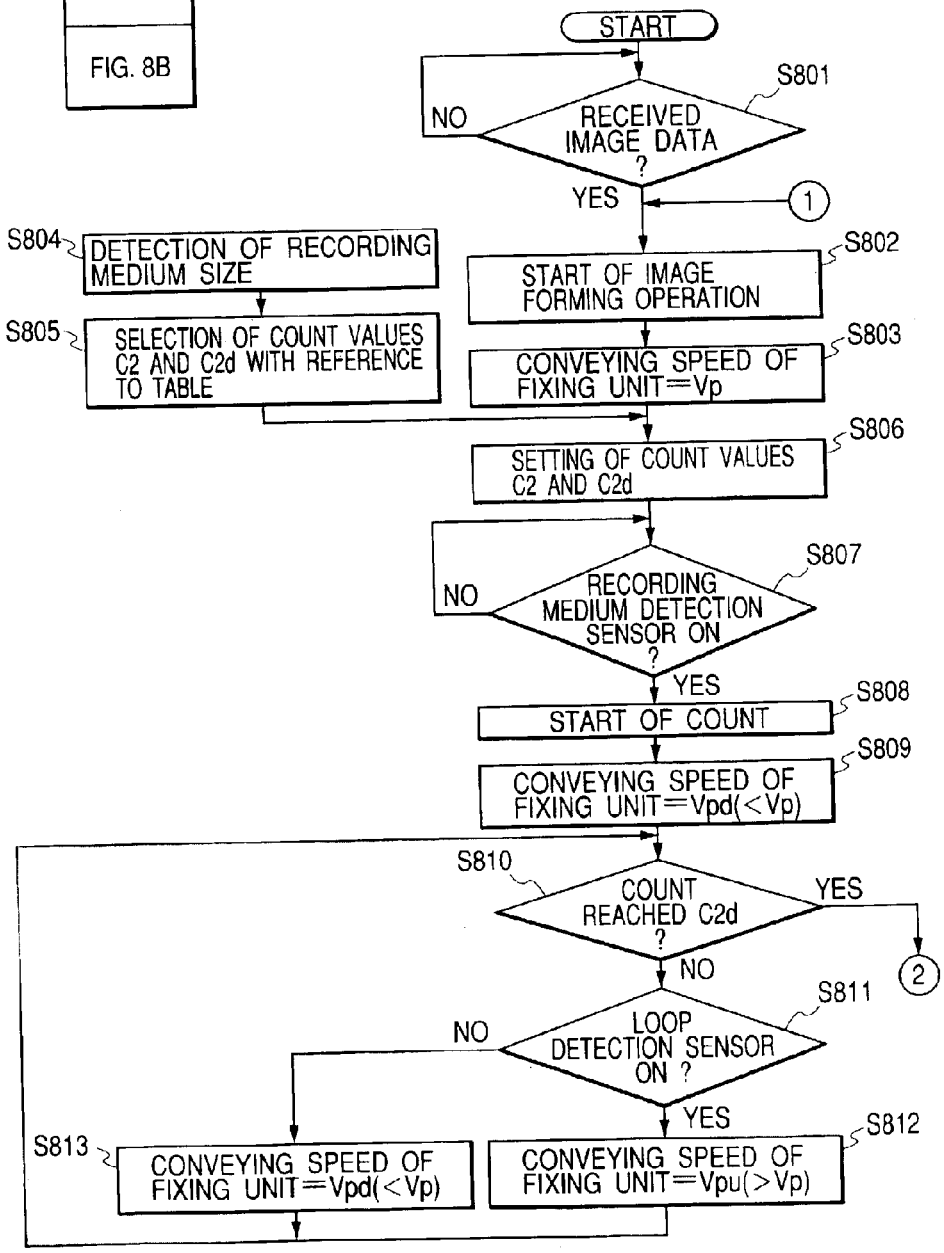
Figure 8B:
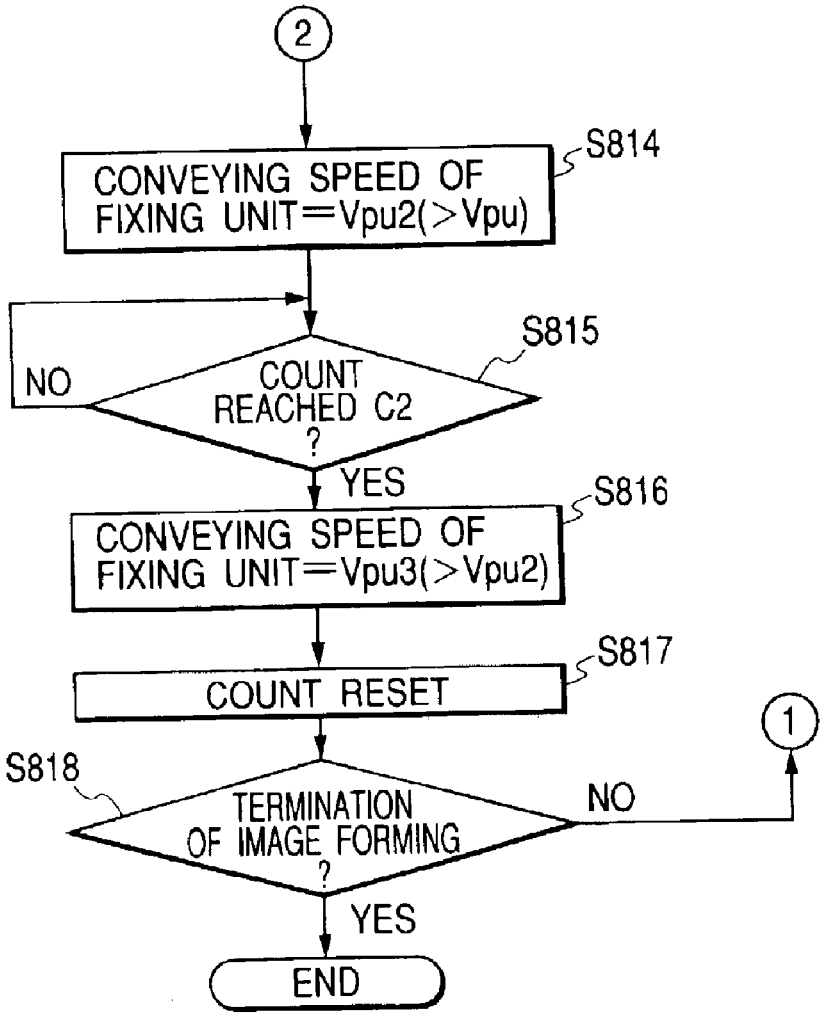

Embodiment 3 will be described using FIGS. 8A and 8B. Note that Embodiment 3 is a modification of Embodiment 2, so that its description will be made of only different points from Embodiment 2.

In Embodiment 2, in step S715, it is judged whether or not the trailing end of the recording medium 10 has been passed through the transferring portion according to whether or not the count has reached C2. If the count has reached C2, the operation advances to step S716 and the conveying speed of the fixing unit is returned to Vp.

On the other hand, in Embodiment 3, in step S816, the conveying speed of the fixing unit 11 is set to Vpu3 still higher than Vpu2 to perform a fixing operation and a discharging operation to the recording medium 10. Note that, at the time point of "YES" judged in step S815, the trailing end of the recording medium 10 has been passed through the image forming portion and the recording medium 10 is being conveyed by only the fixing unit 11. Therefore, even if the conveying speed at this time point is increased to a higher speed, there occurs no pulling of the recording medium 10 at different portions.

As described above, by increasing the conveying speed after the trailing end of the recording medium 10 is passed through the transferring portion to the higher speed, improvement of the throughput can be achieved without causing any problem to the image forming operations.

Embodiment 4

Embodiment 4 will be described using FIGS. 9, 10A and 10B.

In Embodiments 1 to 3, the process speed Vp is described as being constant. However, there are plural kinds of recording medium on which the image forming apparatus can form an image, so that the process speed may be allowed to vary in accordance with those kinds. As a result, a satisfactory image can be formed in accordance with the kind of recording medium. In Embodiment 4, which is a modification of Embodiments 1 to 3, plural conveying speeds can be set as the process speed Vp.

Hereinbelow, a description will be made of an embodiment in the case where the plural process speeds Vp can be set in Embodiment 1. It is needless to say that the plural process speeds Vp can be set also in Embodiments 2 and 3.

In this embodiment, there are assumed four kinds of recording medium, that is, a plain paper (64 to 105 g/m$^2$), a heavyweight paper (heavier than 105 g/m$^2$), a glossy film, and an OHT. In accordance with those kinds of recording medium, the process speed is changed over to Vp1, Vp2 (Vp1/2), Vp3 (Vp1/3), and Vp4 (Vp1/4), respectively.

Figure 9:
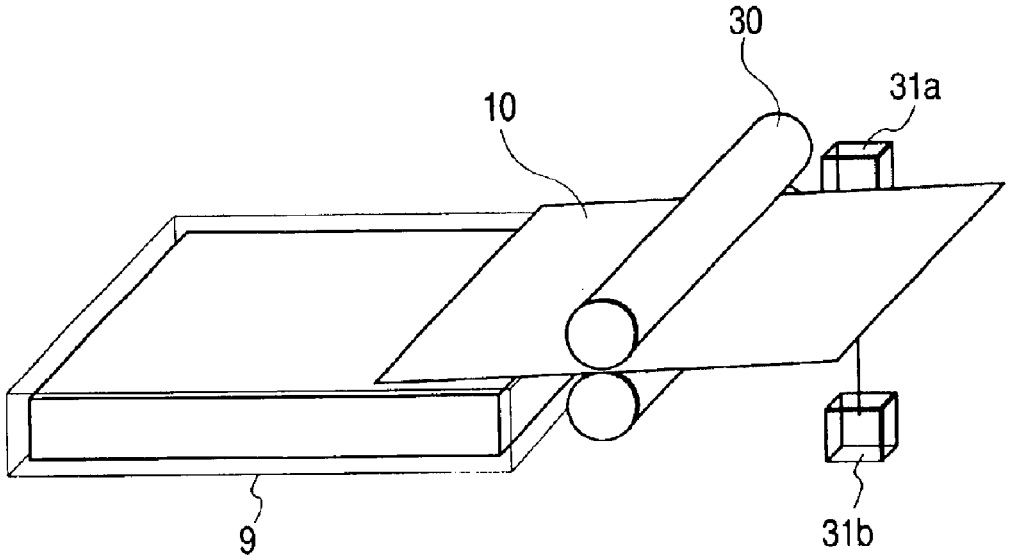
FIG. 9 is an explanatory view showing a kind-of-recording-medium detection sensor.

FIG. 9 shows the vicinity of the sheet feeding unit 9 in FIG. 1. Reference numeral 30 denotes a feed roller that feeds the recording medium 10. Reference numeral 31 denotes a kind-of-recording-medium detection sensor that is composed of a light emitting element 31*a* and a light receiving element 31*b*. As shown in FIG. 9, light, which is emitted from the light emitting element 31*a* and transmitted through the recording medium 10, is received by the light receiving element 31*b*. Based on the received amount of light, the kinds of recording medium 10 are discriminated.

An operation of Embodiment 4 will be described using the flowchart shown in FIGS. 10A and 10B. Note that the following example is a modification of Embodiment 1, so that a description will be mainly made of steps S1003 to S1005 concerning setting of the process speed Vp.

In step S1003, it is judged whether or not there is the setting of the kind of recording medium by a user from an operation panel (not shown) of the image forming apparatus or the like. If there has been the setting by the user ("YES" in step S1003), the operation advances to step S1005. Then, as the process speed Vp, one of the process speeds Vp1 to Vp4 according to the kind of recording medium is set.

In step S1004, in response to the fact that there has been no setting of the kind of recording medium by the user in step S1003, the kind of recording medium is detected by the kind-of-recording-medium detection sensor 31. Then, in step S1005, as the process speed Vp, one of the process speeds Vp1 to Vp4 according to the kind of recording medium is set.

Vpd to be set in step S1012 is assumed to be a speed based on Vp. Depending on which of the speeds Vp1 to Vp4 is set as Vp, Vpd is also variably set. Vpd can be set to an arbitrary value as long as Vpd is lower than Vp. In this embodiment, as an example, Vpd is assumed to be a speed of 95% of Vp, that is, Vpd=0.95 Vp.

Similarly, Vpu to be set in step S1014 is also assumed to be the speed based on Vp. Depending on which of the speeds Vp1 to Vp4 is set as Vp, Vpu is also variably set. Vpu can be set to an arbitrary value as long as Vpu is lower than Vp. In this embodiment, Vpu is assumed to be the value calculated by using Expression 1 in Embodiment 1.

The count C1*d* has been described as identical to that of Embodiment 1. However, by setting the count value according to the kind of recording medium, an appropriate control according to the kind of recording medium can be performed. For example, the heavyweight paper is sturdy compared with the plain paper. Thus, if a loop is formed in the heavyweight paper by using the count C1*d* similarly to the case of the plain paper, there occurs a repulsive force in the heavyweight paper which is larger than that in the plain paper. In view of this, in the case of the heavyweight paper, by setting a smaller value than the count C1*d*, the amount of loop formed therein can be reduced, so that a satisfactory image can be formed. The value for the count C1*d* in the case of the heavyweight paper is preferably set to the value counted by the counter 20 after the leading end of the recording medium 10 is detected by the recording medium detection sensor 14 until ⅓ to ½ of the length of the recording medium 10 in the conveying direction has been left to be conveyed.

As described above, Vp is variably set and Vpu and Vpd are set to appropriate values based on Vp as well. As a result, even if the process speed Vp is changed in accordance with the kind of recording medium, it is possible to provide an image forming apparatus in which no image defect occurs due to variation of the roller diameter of the fixing unit 11 or the like. In addition, no image defect occurs due to bounce of the trailing end of the recording medium 10 when passing through the transferring portion.

Also, the conveyed position of the trailing end of the recording medium, which is to be a timing for changing over the control of the conveying speed of the fixing unit 11, may be allowed to vary in accordance with the kind of recording medium, so that an appropriate image can be formed regardless of the kind of recording medium.

As described above, there can be provided an image forming apparatus in which, based on the progress of the recording medium after the leading end of the recording medium is detected, the conveying speed of the fixing portion is controlled. As a result, there occurs no pulling of the recording medium at different portions or the like, while the vibration of the trailing end of the recording medium when the trailing end of the recording medium is passed through the transferring portion is suppressed. Consequently, no deterioration occurs in image quality such as disturbance of the toner image.

It should be noted that the present invention is not limited to the embodiments as described hereinabove, and it is needless to say that various other modifications can be readily made without deportioning from the scope of the claims appended hereto.

What is claimed is:

1. An image forming apparatus comprising:

a transferring portion that transfers a toner image formed on an image bearing member onto a recording medium at a transfer position and conveys the recording medium at a predetermined speed;

a fixing portion that fixes the toner image transferred onto the recording medium; and a control portion that controls a conveying speed at which the fixing portion conveys the recording medium according to a position of a trailing end of the recording medium, wherein the control portion sets the conveying speed so as to form a loop in the recording medium until the trailing end of the recording medium reaches a predetermined position at an upstream side of the transfer position in a conveying direction, and sets the conveying speed to a speed higher than a predetermined speed to reduce an amount of loop after the trailing end of the recording medium reached the predetermined position.

2. An image forming apparatus according to claim 1, further comprising a loop detection portion that detects the amount of loop by the transferring portion and the fixing portion, wherein, until the trailing end of the recording medium reaches the predetermined position, the control portion sets the conveying speed to form a predetermined amount of loop in the recording medium based on a detection result from the loop detection portion.

3. An image forming apparatus according to claim 2, wherein, the loop detection portion outputs a with-loop signal or a without-loop signal in accordance with the presence or absence of the predetermined amount of loop, and wherein, until the trailing end of the recording medium reaches the predetermined position, the control portion sets the conveying speed to become higher than the predetermined speed at which the transferring portion conveys the recording medium in response to the with-loop signal, and sets the conveying speed to become lower than the predetermined speed in response to the without-loop signal.

4. An image forming apparatus according to claim 1, wherein the control portion sets the conveying speed so that a mean value of the conveying speed during the time when one recording medium is passed through the fixing portion becomes substantially equal to the predetermined speed of the transferring portion.

5. An image forming apparatus according to claim 1, further comprising:

a recording medium detection portion that detects the recording medium; and a judgment portion that judges whether the trailing end of the recording medium has reached the predetermined position at the upstream side of the transfer position in the conveying direction based on a detection result from the recording medium detection portion.

6. An image forming apparatus according to claim 5, further comprising:

a size setting portion that sets a size of the recording medium; and a signal output portion that outputs an output signal in accordance with a conveyed distance of the recording medium conveyed by the transferring portion, wherein the judgment portion judges whether the trailing end of the recording medium has reached the predetermined position based on the size of the recording medium set by the size setting portion and the output signal from the signal output portion, which is obtained after the recording medium detection portion detects a leading end of the recording medium.

7. An image forming apparatus according to claim 1, wherein, in response to the condition that the trailing end of the recording medium has reached the transfer position, the control portion sets the conveying speed to a speed higher than the predetermined speed.

8. An image forming apparatus according to claim 1, further comprising a recording medium discrimination portion that discriminates a kind of recording medium, wherein the predetermined speed setting portion variably sets the predetermined speed in accordance with the kind of recording medium discriminated by the recording medium discrimination portion.

9. An image forming apparatus according to claim 1, further comprising a recording medium discrimination portion that discriminates a kind of recording medium, wherein the control portion variably sets the predetermined position in accordance with the kind of recording medium discriminated by the recording medium discrimination portion.

10. An image forming apparatus according to claim 1, further comprising a plurality of transferring portions that sequentially transfer toner images in different colors onto the recording medium, wherein, in response to a condition that the trailing end of the recording medium has reached the predetermined position with respect to the transferring portion at a most downstream side in the conveying direction of the recording medium, the control portion sets the conveying speed to thereby reduce the amount of loop.

11. An image forming method for use with an image forming apparatus including a transferring portion that transfers a toner image formed on an image bearing member onto a recording medium at a transfer position and a fixing portion that fixes the toner image transferred onto the recording medium, said image forming method comprising:

a first control step for conveying the recording medium at a predetermined speed in the transferring portion, a second control step for setting a conveying speed in the fixing portion to form a loop in the recording medium until the trailing end of the recording medium reaches a predetermined position at an upstream side of the transfer position in a conveying direction, a third control step for setting the conveying speed to a speed higher than a predetermined speed to reduce an amount of loop after the trailing end of the recording medium as a predetermined position at an upstream side of the transfer position in a conveying direction.

12. An image forming method according to claim 11, wherein, in the second control step, until the trailing end of the recording medium reaches the predetermined position, the conveying speed is set to make the transferring portion and the fixing portion form a predetermined amount of loop in the recording medium.

13. An image forming method according to claim 12, wherein, in the first control step, the conveying speed is set to a first speed lower than the predetermined speed at which the transferring portion conveys the recording medium or a second speed higher than the predetermined speed, to thereby form the predetermined amount of loop.

14. An image forming method according to claim 11, wherein, in the second control step and the third control step, a mean value of the conveying speed of the recording medium passed through the fixing portion is substantially equal to the predetermined speed at which the transferring portion conveys the recording medium.

15. An image forming method according to claim 11, further comprising:

a size setting step for setting a size of the recording medium; and a detection step for detecting the recording medium, wherein, in the first control step, it is judged whether the trailing end of the recording medium has reached the predetermined position based on the size of the recording medium set in the size setting step and a detection result obtained in the detection step.

16. An image forming method according to claim 11, further comprising a fourth control step for, in response to the condition that the trailing end of the recording medium has reached the transfer position, setting the conveying speed to be higher than the predetermined speed.

17. An image forming method according to claim 11, further comprising:

a recording medium discrimination step for discriminating a kind of recording medium; and a speed setting step for variably setting the predetermined speed at which the transferring portion conveys the recording medium in accordance with the kind of recording medium discriminated in the recording medium discrimination step.

18. An image forming method according to claim 11, further comprising a recording medium discrimination step for discriminating a kind of recording medium, wherein the predetermined position is variably set in accordance with the kind of recording medium discriminated in the recording medium discrimination step.

19. An image forming method according to claim 11, wherein, the image forming apparatus includes a plurality of transferring portions that sequentially transfer toner images in different colors onto the recording medium, and wherein, in the third control step, in response to a condition that the trailing end of the recording medium has reached the predetermined position with respect to the transferring portion at a most downstream side in the conveying direction of the recording medium, the conveying speed is set to thereby reduce the amount of loop in the first control step.

20. An image forming apparatus comprising:

a transferring portion that transfers a toner image formed on an image bearing member onto a recording medium at a transfer position;

a fixing portion that fixes the toner image transferred onto the recording medium; and a control portion that controls a conveying speed of the recording medium according to a position of a trailing end of the recording medium, wherein the control portion sets the conveying speed to form a loop in the recording medium until the trailing end of the recording medium reaches a predetermined position at an upstream side of the transfer position in a conveying direction, and sets the conveying speed to reduce an amount of loop after the trailing end of the recording medium reaches the predetermined position.

21. An image forming method according to claim 20, wherein, in response to the condition that the trailing end of the recording medium has reached the transfer position, the control portion sets the conveying speed to accelerate.

* * * * *

UNITED STATES PATENT AND TRADEMARK OFFICE

CERTIFICATE OF CORRECTION

PATENT NO. : 6,892,038 B2
DATED : May 10, 2005
INVENTOR(S) : Takayuki Fukutani

Figure 10:
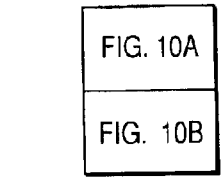
FIGS. 10A and 10B are flowcharts for explaining Embodiment 3.
Figure 10A:
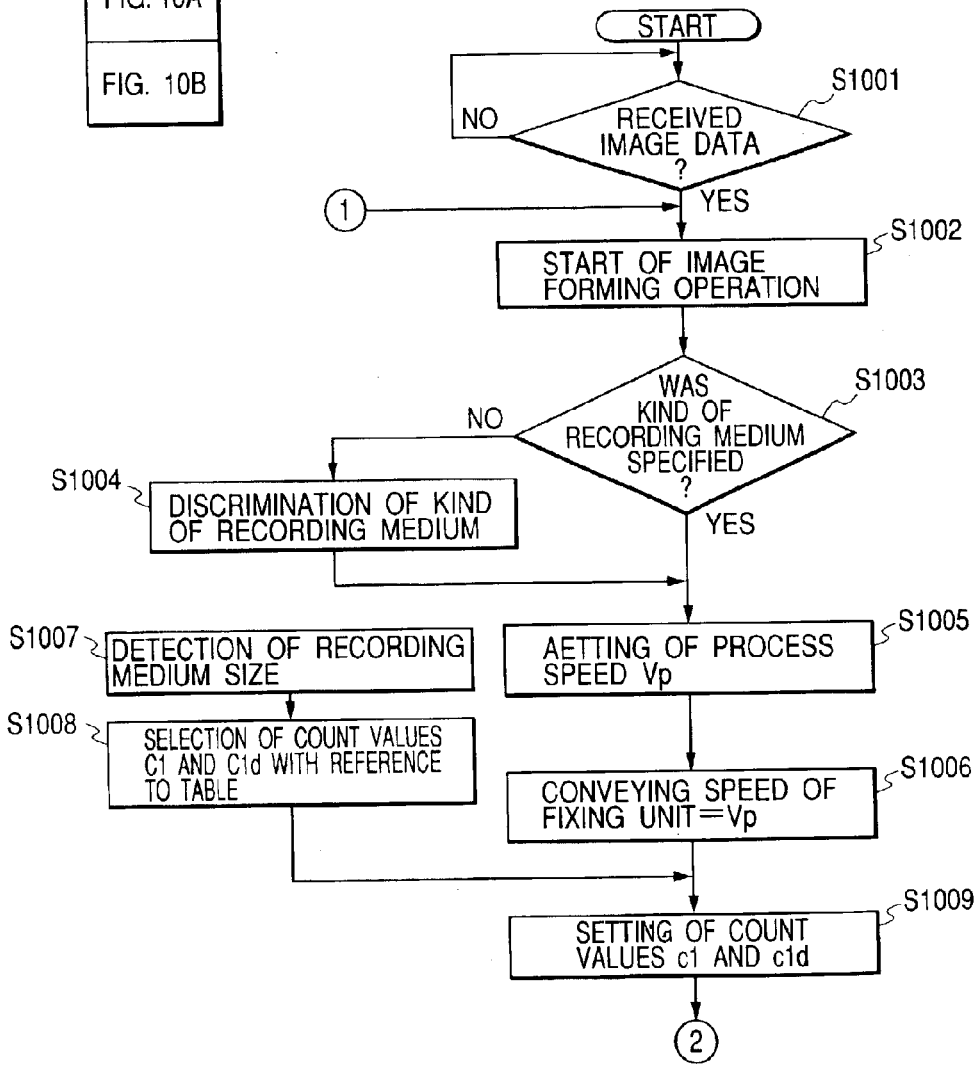
Figure 10B:
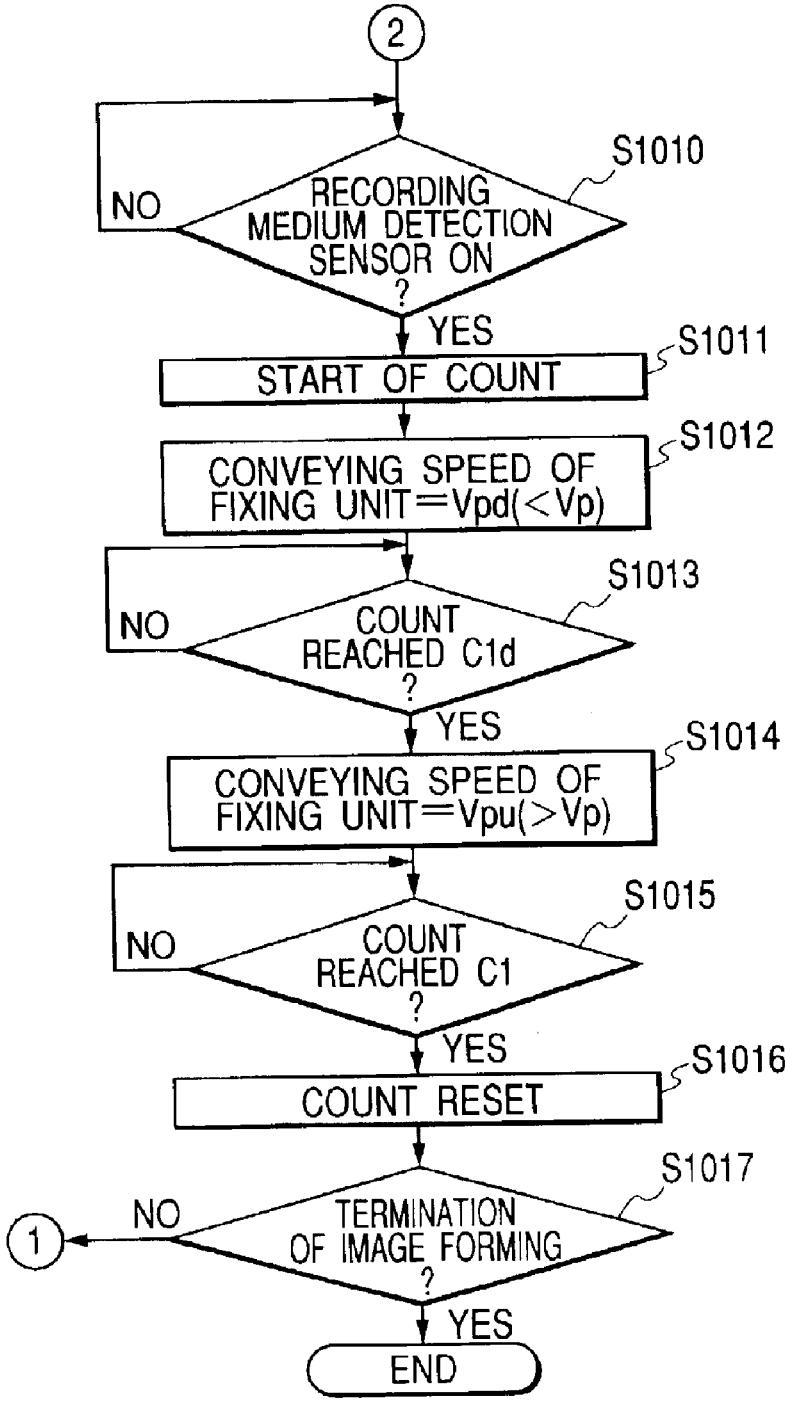

It is certified that error appears in the above-identified patent and that said Letters Patent is hereby corrected as shown below:

Drawings,
Sheet 12, Figure 10, “AETTING” should read -- SETTING --.

Column 1,
Lines 31 and 33, “imported” should read -- imparted --.

Column 3,
Line 26, “imported” should read -- imparted --;
Line 28, “downstream” should read -- downstream end --; and
Line 51, “position-on” should read -- position on --.

Column 4,
Line 52, “importioned” should read -- imparted --.

Column 5,
Line 59, “rotation” should read -- rotations --.

Column 6,
Line 4, “a” should read -- an --; and
Line 51, “Vd·Td” should read -- Vp·Td --.

Column 7,
Line 30, “to” should be deleted.

Column 9,
Line 16, “a” should read -- an --;
Line 17, “rotation” should read -- rotations --;
Line 19, “to reduce” should read -- reduction of --;
Line 27, “rotation” should read -- rotations --;
Line 40, “downstream” should read -- downstream end --; and
Line 47, “to reduce” should read -- reduction of --.

Column 11,
Line 2, “to form” should read -- formation of --; and
Line 3, “to reduce” should read -- reduction of --.

Column 13,
Line 26, “deportioning” should read -- departing --.

UNITED STATES PATENT AND TRADEMARK OFFICE

CERTIFICATE OF CORRECTION

PATENT NO. : 6,892,038 B2
DATED : May 10, 2005
INVENTOR(S) : Takayuki Fukutani

It is certified that error appears in the above-identified patent and that said Letters Patent is hereby corrected as shown below:

Column 15,
Line 2, “portion,” should read -- portion; --; and
Line 7, “direction,” should read -- direction; --.

Signed and Sealed this

Fourth Day of October, 2005

JON W. DUDAS
*Director of the United States Patent and Trademark Office*